US005865129A

United States Patent [19]

Samples

[11] Patent Number: 5,865,129

[45] Date of Patent: Feb. 2, 1999

[54] KNOCK-DOWN TABLE

[75] Inventor: John Wayne Samples, Afton, Tenn.

[73] Assignee: MECO Corporation, Greeneville, Tenn.

[21] Appl. No.: 863,406

[22] Filed: May 27, 1997

[51] Int. Cl.[6] ..... A47B 47/00

[52] U.S. Cl. ..... 108/157.17; 108/159

[58] Field of Search ..... 108/157.1, 157.17, 108/157.15, 153.1, 158, 159

[56] References Cited

U.S. PATENT DOCUMENTS

| | | | |
|---|---|---|---|
| 1,422,613 | 7/1922 | Ogden | 108/157.1 |
| 1,763,341 | 6/1930 | Brantingham | 108/158 |
| 2,310,904 | 2/1943 | Bales . | |
| 2,660,501 | 11/1953 | Molla . | |
| 2,903,312 | 9/1959 | Lawless . | |
| 3,968,606 | 7/1976 | Facemire | 108/158 |
| 4,467,730 | 8/1984 | Borichevsky . | |

*Primary Examiner*—Peter M. Cuomo
*Assistant Examiner*—Gerald A. Anderson
*Attorney, Agent, or Firm*—Roberts & Brownell, LLC

[57] ABSTRACT

A knock-down table comprises a top frame and attachable legs. The top frame comprises a horizontal surface with a lip about its perimeter, and walls depending downward from the underside of the top frame. An interchangeable table top is placed on the top frame within the confines of the lip. Each downward depending walls has a cutout at each top end corner to form a channel at each underside corner of the top frame. Extending downward from the top frame and in close proximity to each channel is a bolt assembly and a locator pin.

A plurality of tapered, flanged legs that are roughly L-shaped in cross section are secured to each corner of the top frame by the bolt assemblies. The flanged legs are tapered so that the wider portions of the tapered legs each are proximate to the top frame and extend partially over the downward depending walls when assembled. Located at the top end of the flanged legs are plates, each having a slot and a guide hole therethrough. The plates extend through the channels in the downward depending walls. The slots of the plates engage the bolt assemblies, and are secured by tightening nuts thereon. The locator pins fit within guide holes in the plates of the flanged legs.

Removable shelves are placed between the flanged legs by using at each corner an extension depending downward to engage the cleat in the respective flanged leg by passing through an aperture in the cleat.

Versatility of the knock-down table is apparent from the fact that the interchangeable table tops can be complex works of art, including, for example, ornamental features such as scrolls and intricate inlaid wooden sections.

24 Claims, 9 Drawing Sheets

KNOCK-DOWN TABLE

FIELD OF INVENTION

The present invention relates generally to a table that is shipped in an unassembled form for later assembly by a consumer, known as a "knock-down" table. More particularly, the present invention relates to a knock-down table which has a unique leg attachment method, is easy to assemble, simple in its construction, and includes one or more removable shelves and a plurality of interchangeable decorative table tops.

BACKGROUND AND DESCRIPTION OF RELATED ART

Tables shipped in assembled form are bulky and hard to handle, and also limit the capacity of shipping containers and trucks. These factors add to the handling costs of such tables. Further, assembling a table in the factory necessarily adds assembly costs, which are passed on to the consumer in the form of an increased table cost. A solution to the problems of shipping space and factory assembly expenses is to ship tables in unassembled or "knock-down" form.

Another important concern of table construction is the ease of assembly and disassembly. The current construction of certain tables with intricate moldings and contoured shapes render these tables difficult to assemble. Furthermore, some of these tables cannot be fully disassembled due to their design. This leads to an excessive amount of manufacturing time and costs, and also leads to excessive shipping volume being taken up by the fully assembled table. Proposed solutions have included tables designed with complex assemblies for pivotal or collapsible legs, as well as systems with removable table tops to permit tables to be folded into flattened shapes. These assemblies and systems, while convenient and relatively compact for shipment, have added dramatically to the cost of the tables due to the complexity of manufacturing and assembling. Thus, there remains a need to provide the user with an inexpensive and versatile table that is easy to assemble and disassemble.

Another concern of manufacturers is the versatility of knock-down furniture. For instance, many manufacturers employ interior designers when designing their tables and table components so as to design tables that meet the consumer's needs and tastes, including a range of decorative styles. In this regard, manufacturers are clearly concerned with the user's likes and dislikes. To this end, it is also useful to have simple and inexpensive tables that have interchangeable Components, e.g., decorative table tops, as well as the capability of easy disassembly, especially for those users who have a range of needs and/or tastes applicable to one table. By way of example, a user may need a table for outdoor use, and as such, require a rugged and durable table top. Alternatively, the user may want to bring the same table inside, at which time a more formal or more decorative table top is desired. Any such table tops should be easily removable and interchangeable.

Manufacturers of knock-down tables are also concerned with the easy assembly and disassembly of a table, including the capability of compact storage. Disassembly includes the ability to fully dismantle all components of the table, including the legs, shelves, and table top. It is also highly desirable to facilitate disassembly by designing a simple table construction, such as pop-in pieces, which do not utilize bolts or other mechanical means.

Several inventors have attempted to devise methods for the construction of tables to facilitate easy assembly and disassembly. For example, U.S. Pat. No. 2,310,904 to J. E. Bales discloses a gas welding table consisting of four legs, wherein each leg has an extension-like flange having a vertical and a horizontal portion. Placed on the horizontal portion of the extension-like flange is a shelf having an inwardly extending flange and a plurality of ridges for storage purposes. A plurality of side panels are attached via a bolt assembly to the upper portion of the legs. Each side panel is provided with an outstanding horizontally and upstanding flange. Center reinforcement strips are also provided, and are disposed parallel to opposed pairs of side panels for additional support. The top of the table consists of noninterchangeable firebricks that lie on the legs and center reinforcement strips. Though designed for user assembly, this table is not designed for easy assembly and disassembly. Further, the table is not a consumer item, is very complex, and does not lend itself to varying uses, such as a variety of recreational uses.

U.S. Pat. No. 2,660,501 to C. P. Molla describes a combination table leg and table top retainer. Specifically, this invention relates to a detachable leg structure, wherein the leg members consist of upward extending end portions which protrude above the upper surface of the table frame to engage peripheral edges of a table top. The leg members are formed from a single strip of metal and are secured to a frame. The frame comprises four sides, each side having depending peripheral and horizontal walls. The horizontal walls are cut at a 45 degree angle to meet the horizontal walls of the adjacent side of the frame.

Another table construction is described in U.S. Pat. No. 2,903,312 to C. J. Lawless (the "'312 patent"). The '312 patent discloses a reversible table top construction, wherein leg assemblies are secured to a support frame at their upper ends. The support frame comprises an upwardly extending peripheral flange conforming to the shape of the table top. The table top includes a rectangular table top having a top, a bottom, and edges. The edges of the table top have bore portions which have magnets anchored therein, and are aligned with apertured portions of the upwardly extending peripheral flanges. Ferrous material retaining pins extend through the apertured portions of the upwardly extending peripheral flange, and the bored portions of the panel have the magnets disposed therein. The retaining pins maintain the position of the table top within the support frame. This invention provides a novel method of leg attachment.

Lastly, U.S. Pat. No. 4,467,730 to Borichevsky discloses a table with a releasable top for outdoor use. This invention provides a table with a plurality of U-shaped leg frames, each having a recess therein. The U-shaped leg frames are permanently attached to one another, thereby forming the frame of the table. The recess consists of a downwardly directed bottom wall and an upwardly directed top wall, wherein the top wall has a lip which overhangs the recess. The two walls are disposed in angular relationship to each other. The table top fits into the recess of the U-shaped leg frames. When in place, the table top is located below the plane of the top surfaces of the leg frames, and is held in place by the overhanging lips of the recess.

All of the above references use fastening mechanisms and complex assemblies that do not necessarily allow for easy manufacture, assembly, and disassembly in a manner that would lend itself to consumer uses. Further, the above references do not afford the user with a table that has interchangeable parts, and that is capable of being fully dismantled into its constituent components for compact shipping and storage. Additionally, these above tables do not cater to varying consumer uses, such as for outdoor and indoor activity.

What is needed to meet the needs of consumers for occasional tables and the construction thereof is a durable table that allows for easy manufacture and subsequent assembly, interchangeability of table parts, and the advantage of being able to be fully dismantled for shipping and storage. Such a table would include several table tops of varying designs that can be interchanged by the user, yet be easy to assemble and disassemble. The table would be constructed so that all constituent components are securely fixed to one another utilizing a simple design fashioned for easy assembly and disassembly. The construction of the table would also include at least one removable shelf disposed between the legs (or other places as the user desires) that would further add to the stability and strength of the table. The shelf would have fixed downward leg extensions that would attach to apertures on the table frame. The downward leg extensions would add to the stability and strength of the table by providing a common mechanism that fastens all the legs to a common component. The downward leg extensions would also facilitate the easy assembly of the table, wherein the downward leg extensions also would act as alignment pins for the proper placement and alignment of the shelf with respect to the flanged legs and top frame.

SUMMARY OF THE INVENTION

It is therefore an object of the present invention to provide a table that is easily assembled by a consumer into a finished table.

It is an object of the present invention to provide a table that is capable of being fully dissembled into its constituent components for compact shipping and storage.

It is a further object of the present invention to provide a table that comprises interchangeable components.

It is still a further object of the present invention to provide a table that utilizes removable decorative tops.

It is yet a further object of the present invention to provide a table that utilizes removable shelves.

It is still yet a further object of the present invention to provide a table that is sturdy and rugged.

These and other objects and advantages of the present invention will be apparent to those of ordinary skill in the art upon inspection of the detailed description, drawings, and appended claims.

The "Knock-Down Table" ("the KD Table") is contemplated for use in various settings, including both outdoors and indoors. The present invention is used for a wide variety of purposes, such as accent tables, telephone tables, utility tables and other similar tables. The present invention also allows for easy assembly and disassembly by consumers with no special equipment. The KD Table also facilitates easy construction during the manufacturing process, and eliminates the need for assembly by the manufacturer since the table is to be shipped in knock down form.

Thus, the KD Table is a multi-use table that is easily assembled, and is designed to be used in a variety of different circumstances and for a variety of different purposes, depending on the intent of the individual. The multifaceted nature of the KD Table also affords the user several options that were not previously available, i.e., using the same table for formal as well as casual occasions, depending on the objectives of the individual user at a given point in time.

The KD Table comprises a top frame having a plurality of downward depending walls and a horizontal surface. The downward depending walls have cutouts that form a plurality of channels aligned proximally with the corners of the frame. Integrally molded about the perimeter of the top frame is a lip. The lip, in conjunction with the horizontal surface of the top frame, facilitates the proper alignment and rapid placement of interchangeable decorative table tops. Cutouts in the lip promote easy and quick removal of an interchangeable decorative table top.

A plurality of legs having a roughly L-shaped cross section, defined as "flanged legs," are secured to the corners of the top frame by a bolt and nut assembly, wherein the flanges of a leg (i.e., the sides for each "L") are parallel with the sides of the table top. Integrated into the top portion of the legs are plates that are mounted perpendicular to and attached to the inner surfaces of the flanges. The plates cooperate with the channels of the downward depending peripheral walls, and further comprise slots which each accommodate a bolt and nut assembly.

Fixed to the inner portions of the leg flanges, and roughly at right angles thereto, are cleats. Each cleat has at least one aperture therethrough. Shelves are positioned on the cleats. Integral to the shelves is a downward extension on the underside of each corner, which downward extension is inserted into the aperture of a cleat. It is envisioned that the shelves will be placed at any location on the table leg below the level of the table top.

These downward extensions also facilitate the placement and alignment of the shelves in relation to the top frame and table top. Additionally, the downward extensions of the shelves also add to the stability and strength of the table by providing a common mechanism that fastens the table components and maintains the positions of the legs one to another.

DETAILED DESCRIPTION OF THE INVENTION

The present invention is directed to a knock-down table that has removable shelves and interchangeable decorative table tops, and is easy to assemble and fully disassemble. The dimensions of the KD Table, including length, width, shape, and other variables and quantities specified herein, may vary with the type of knock down table contemplated for use. Therefore, numbers and dimensions specified herein are not to be construed as limitations on the scope of the KD Table. They are meant to be merely illustrative of one particular application. For example, it is contemplated that the height, length and width of the knock-down table may vary for different uses so as to accommodate any number of combinations of table shapes and uses, including accent tables or various utility tables.

The KD Table is designed to have interchangeable decorative tops and removable shelves, and also to be capable of being easily assembled and dismantled. The following applications and usages of the knock-down table are but exemplary illustrations:

(i) accent table (ii) make-up table, (iii) work bench table, (iv) grill table, (v) plant and flower table, (vi) table for displaying photographs and art work, and (vii) changing table for infants.

Other embodiments will be obvious to those skilled in the art. The KD Table is designed from any material that is suitable for this purpose that also provides strength, stability, and support. In the preferred embodiment of the KD Table a steel or other metal frame and shelves with various decorative table tops are used. The shape of the KD Table will vary in accordance with its various applications, and materials other than metal may be used for the frame and shelves.

Figure 1:
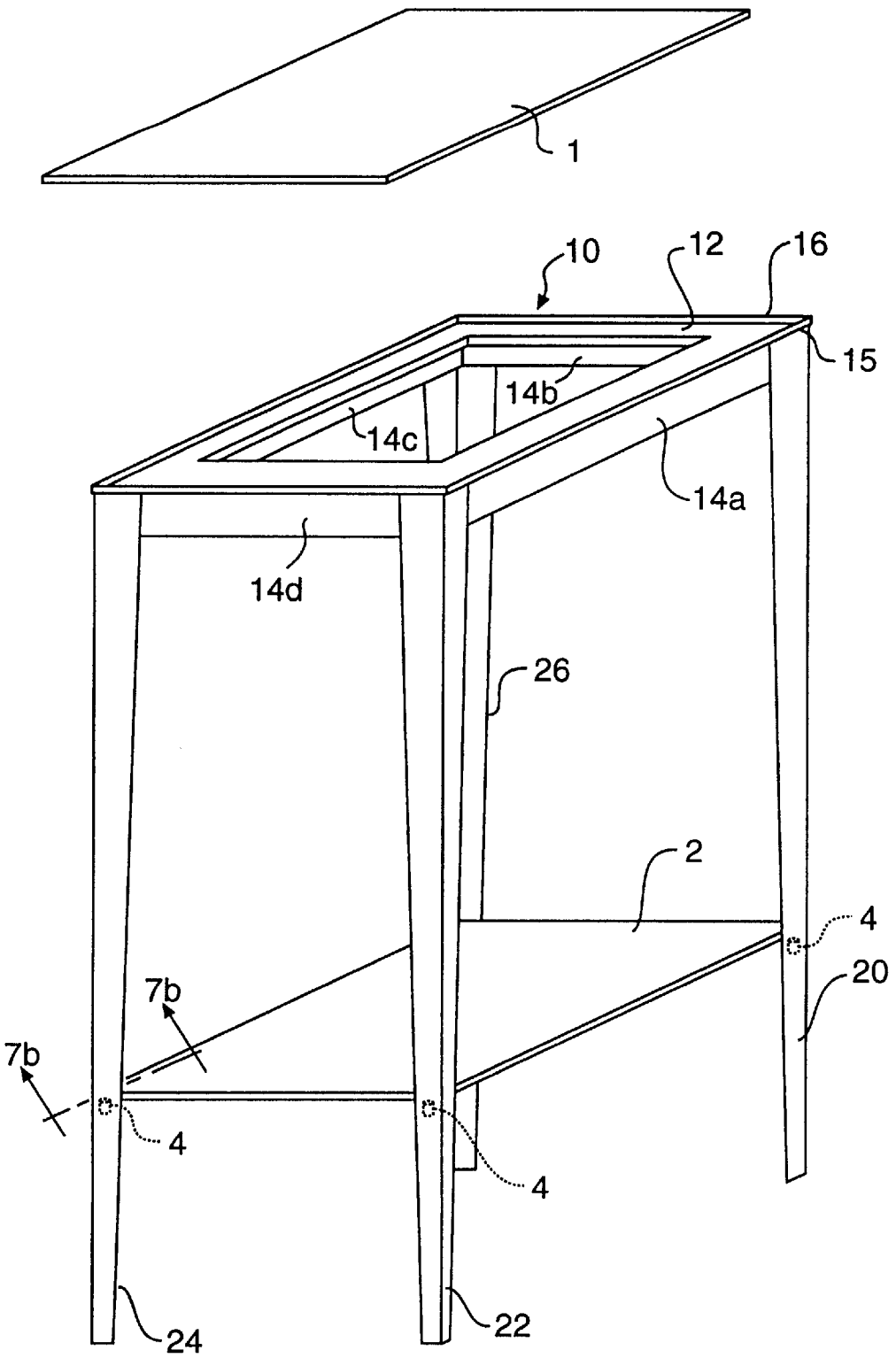
FIG. 1 shows a perspective view of the knock-down table.

FIG. 1 shows a perspective view of the KD Table. The knock down table comprises a top frame 10 having downward depending walls 14*a*, 14*b*, 14*c* and 14*d*, and a horizontal surface 12. Integral to the perimeter of the top frame 10, and in a common plane to the respective downward depending walls 14*a*, 14*b*, 14*c* and 14*d*, is an upwardly extending lip 16. The upwardly extending lip, in conjunction with the horizontal surface 12 of the top frame, facilitates the proper alignment and rapid placement of interchangeable decorative table tops 1. The interchangeable decorative tops may be made of glass (including mirrors), Formica, ceramic, wood, stone, or other such suitable materials. It should be noted that the KD Table, and more particularly the decorative top is not limited by the above examples.

The decorative tops may fit snugly or loosely within the confines of lip 16. Alternatively, the decorative tops may fit snugly by pressure fit, including the use of rubber or other readily compressible material attached by any conventional means, including by glue, about the outer edges of the tops. In the preferred embodiment, the decorative tops are square or rectangular, though alternate shapes are also contemplated in alternative embodiments. Cutouts (not shown) may be made in the lip to provide access holes for easier removal of the decorative tops.

A plurality of tapered legs having a roughly L-shaped cross section, defined as flanged legs 20, 22, 24 and 26, are secured to the corners of the top frame by a bolt and nut assembly, as is explained in detail below. The flanged legs 20, 22, 24 and 26 are tapered so that the wider portion of the tapered legs is proximate to the top frame, and each leg includes a plate that extends through a slot in the downward depending walls 14*a*, 14*b*, 14*c* and 14*d* when assembled.

Structural integrity and strength is added to the KD Table by allowing the top frame to rest on the flanged legs, adding a nut to each bolt assembly, and tightening each nut against the plate of the respective flanged leg. Further strength is obtained by the use of one or more removable shelves.

A removable shelf 2 is placed between the flanged legs at some distance between the top frame and the floor. Alternate embodiments of the KD Table envision at least one other shelf. The placement and location of the shelf or shelves may be varied according to the desires and needs of the user.

Spot welded or integral to the underside of the removable shelf 2 are downward extensions 4 proximate to each corner. Other fastening mechanisms, such as a nut and bolt assembly or a pressure fit clip mechanism, are also envisioned. Alternatively, the corners/edges of the shelf can simply be bent down at an angle of about 90° to engage slots or holes in cleats attached to the table legs. The downward extensions 4 facilitate the placement and alignment of the shelf in relation to the top frame and table top. Additionally, the downward extensions of the KD Table add to the stability and strength of the table by providing a common mechanism that fastens the table components, as is discussed in greater detail below.

Figure 2:
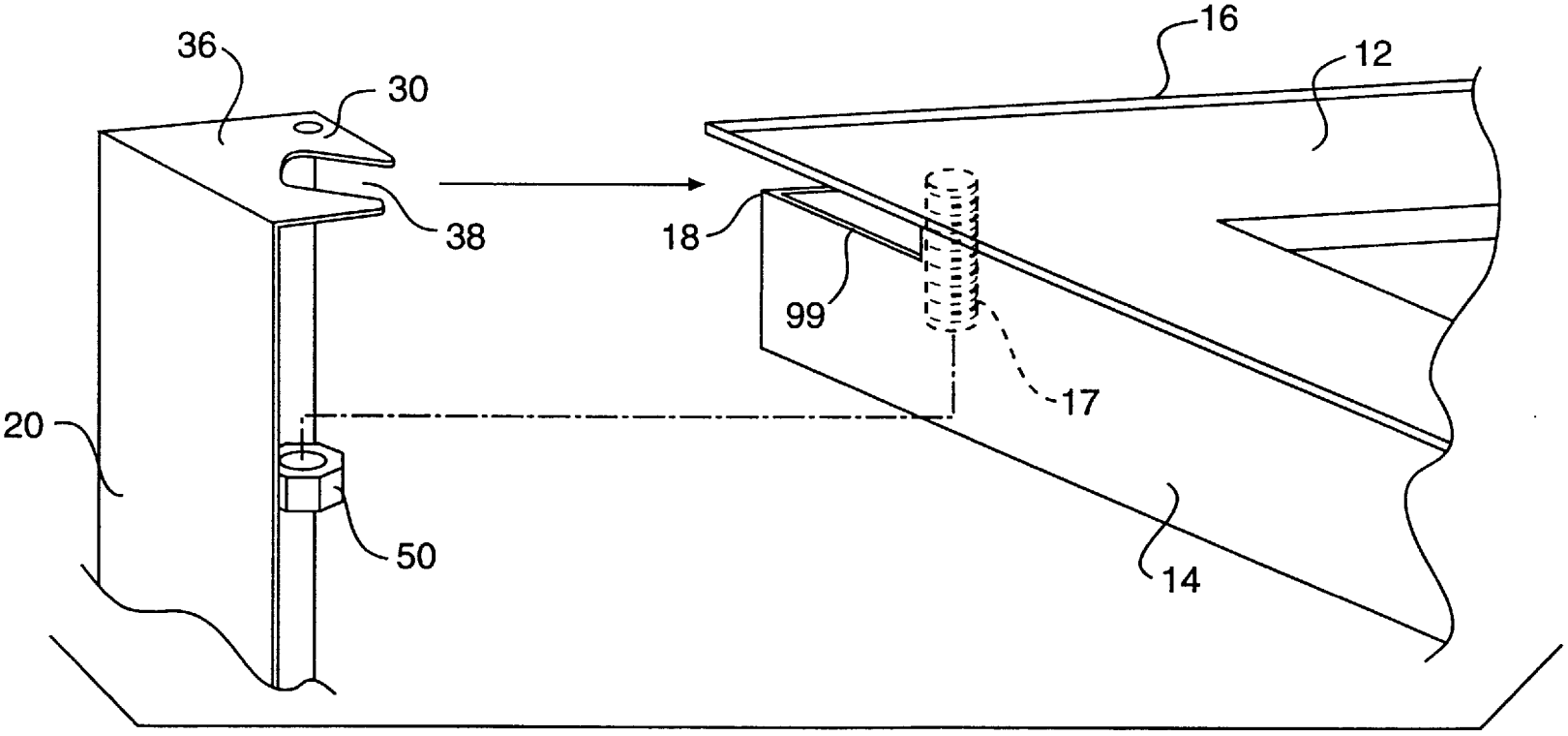
FIG. 2 shows an enlarged fragmentary perspective of a corner sectional portion of the knock-down table.

Referring to FIG. 2, an enlarged fragmentary view of a corner portion of the KD Table is shown. The upper end of flanged leg 20 has a plate 36 that is spot welded to the upper portion of the flanged leg 20. The plate 36 is substantially quadrilateral (other shapes are also envisioned), and comprises a slot 38 and a guide hole 30. As noted, the plate 36 is spot welded onto the upper portion of the flanged legs 20, 22, 24 and 26, and is mounted approximately perpendicular to the flanges of the legs. In alternative embodiments, the plate 36 is integrally molded into the upper portion of the flanged legs.

Also depicted in FIG. 2 is a fragmentary view of a corner portion of the top frame 10. As stated previously, the top frame comprises the horizontal surface 12, downward depending walls 14*a*, 14*b*, 14*c* and 14*d*, a horizontal surface 12, and a lip 16. On the underside of the horizontal surface 12, located proximally to each of the corners of the top frame 10, is a bolt assembly 17 that extends downward. Alternate embodiments of the KD Table envision other fastening means, such as latches, locks, or rivets extending downward from the corners of the top frame.

Each of the downward depending walls 14*a*, 14*b*, 14*c* and 14*d* have a top, a bottom, and two ends. At the top ends of each downward depending wall are rectilinear cutouts 99. The downward depending walls are spot welded about the perimeter of the underside of the top frame. The ends of the downward depending walls are in proximity to, but not touching, the respective ends of the walls adjacent thereto.

Figure 8:
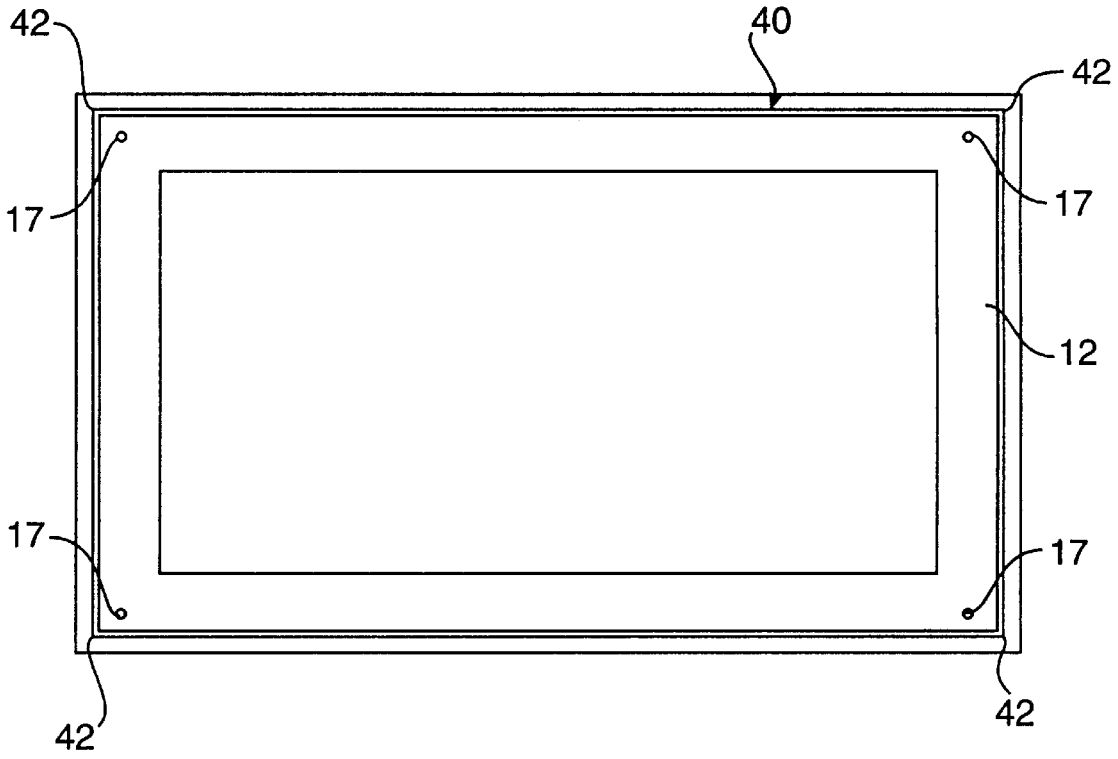
FIG. 8 shows an alternate table top having a single dependent wall around the table top periphery.

An alternate table top is shown in FIG. 8. In this embodiment, a single downward dependent wall 40 comprises four 90° 42 bends wrapped around the underside of the top frame. This downward dependent wall has cutouts defined as channels at the underside corners of the top frame (not shown).

When the downward depending walls 14*a*, 14*b*, 14*c* and 14*d* are fixed to the underside of the top frame, the rectilinear cutouts 99 of each downward depending wall form channels 18 on the underside of each corner of the top frame. The channels extend about the corners of the top frame. The channels are further aligned about the bolt assemblies. The plates 36 of the legs cooperate with channels 18, as described below.

The plates 36 of the flanged legs 20, 22, 24 and 26 extend through the respective plurality of channels 18 of the top frame. As such, the dimensions of the channels are slightly larger than the plates so that the plates may extend therethrough. Thereafter, the slot 38 located on the plate 36 engages the bolt assembly 17. The channels, plates, slots, and bolt assemblies permit proper alignment and easy assembly of the KD Table. After engagement of the channels, plates, slots, and bolt assemblies, the top sides of the plates rest on the underside of the top frame.

The downward depending walls 14*a*, 14*b*, 14*c* and 14*d* and the flanged legs 20, 22, 24 and 26 are securely fitted against one another, wherein the inner surfaces of the flanged legs extend partially over the outer surfaces of the downward depending walls. This configuration adds to the strength and stability of the KD Table because the outer surfaces of the downward depending walls brace the flanged legs against excessive vertical and lateral movements and other various loads.

The channels, plates, slots, and bolt assemblies facilitate easy assembly and disassembly. For example, the assembler of the KD Table aligns the plates 36 with the channels 10 of the downward depending walls 14*a*, 14*b*, 14*c* and 14*d*, and thereafter extends the plates 36 through the channels 18. The slots 38 are then aligned and permitted to cooperate with the bolt assemblies. Once aligned and cooperating, the bolt assembly 17 is securely fastened by a nut 50. As an alternative to a nut and bolt assembly, rivets, lugs, or locks can be used. Disassembly of the KD Table is by mere reversal of the above sequence of steps. Thus, in order to assemble and disassemble the KD Table, only four nuts (or other fastening means) need to be fastened or unfastened, respectively, to the bolt assemblies. Lock washers may be utilized between the upper sides of the nuts and the under sides of the plates.

If the user wishes to use other decorative table tops, the user has to only "pop out" the existing table top, and replace it with a desired table top by simply placing it on the horizontal surface 12 within the boundaries of the lip 16. Cutouts (not shown) in the lip may be used to facilitate removal of a table top by creating a place for finger access.

Figure 3:
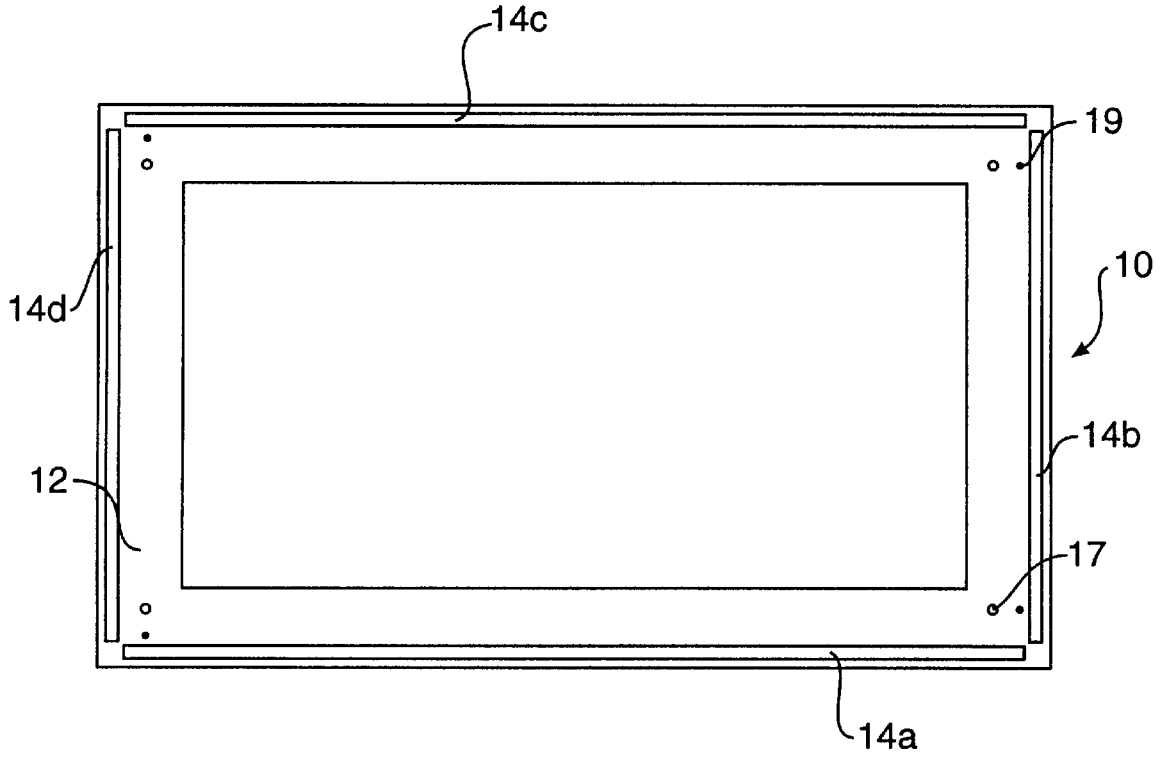
FIG. 3 shows a perspective view of the underside of the top frame of the knock-down table.

Referring to FIG. 3, the underside of the top frame is shown. A locator pin 19 located on the underside of the horizontal surface 12 is shown. The locator pin is located proximate to the bolt assembly 17 and extends downward. The locator pin facilitates the easy assembly of the KD Table by allowing the assembler to align the locator pin with the guide hole 30 in the respective plate (as shown in FIG. 2) during the course of assembly. This, in turn, stabilizes the entire assembly as nuts are tightened. Also seen in FIG. 3 are the downward depending walls 14*a*, 14*b*, 14*c* and 14*d*. As is apparent in the figure, the ends of the downward depending walls do not come into contact with one another. About the corners of the top frame 10 are the channels 18 (not shown here).

Figure 4:
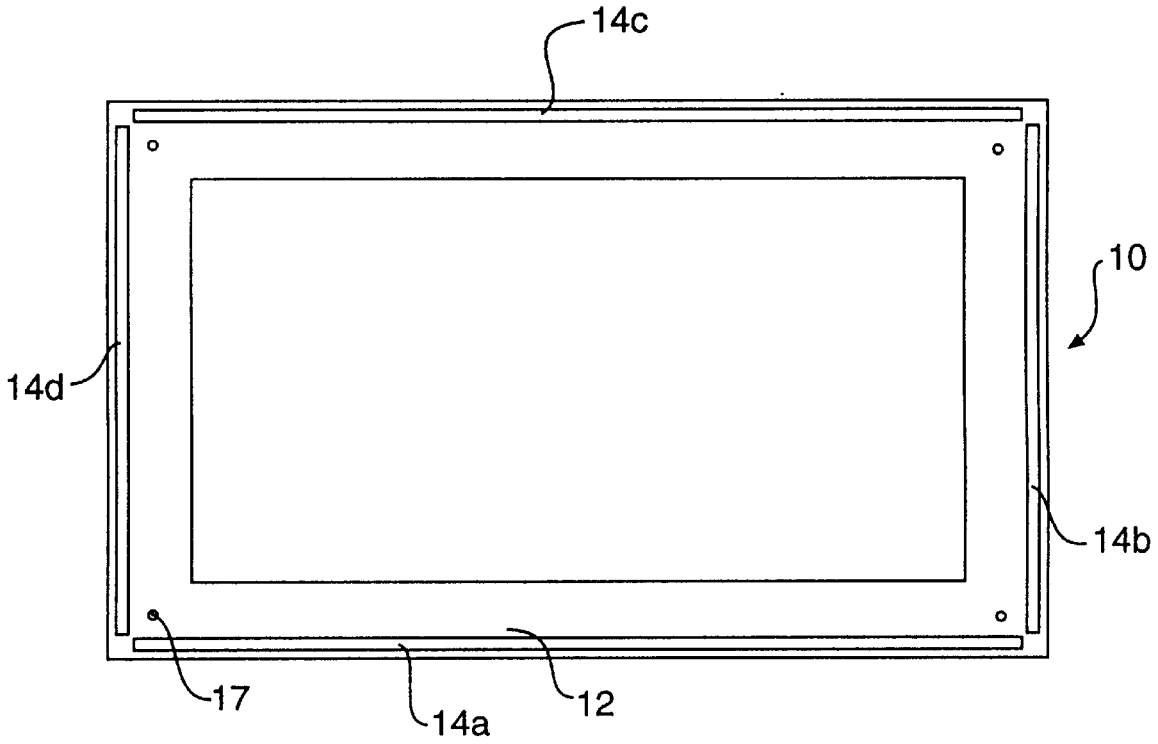
FIG. 4 shows a perspective view of the underside of the top frame of the knock-down table.

FIG. 4 depicts an alternative embodiment wherein the underside of the top frame 10 without a locator pin is shown.

Figure 5:
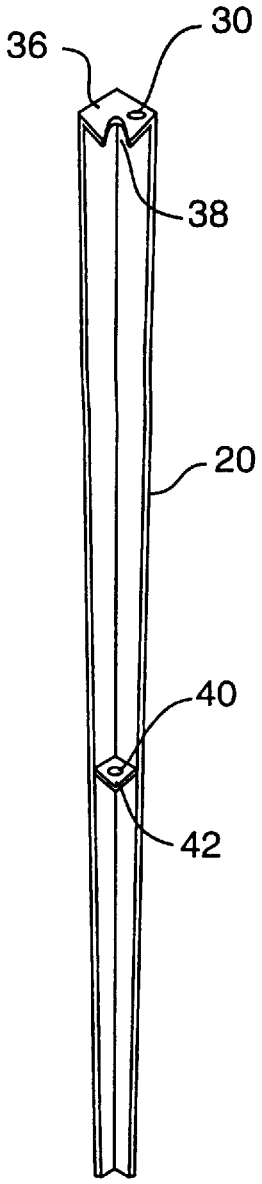
FIG. 5 shows a plan view of a flanged leg.

FIG. 5 shows a perspective view of flanged leg 20, wherein at least one cleat 42 is fixed to flanged leg 20. Flanged legs 20, 22, 24 and 26 each have at least one cleat 42 attached thereto. The cleat is placed parallel to the plate 36 and the top frame 10. Placed within the cleat is an aperture 40. The removable shelf 2 (not shown here) is placed between the flanged legs, and rests on the cleats.

Figure 7B:
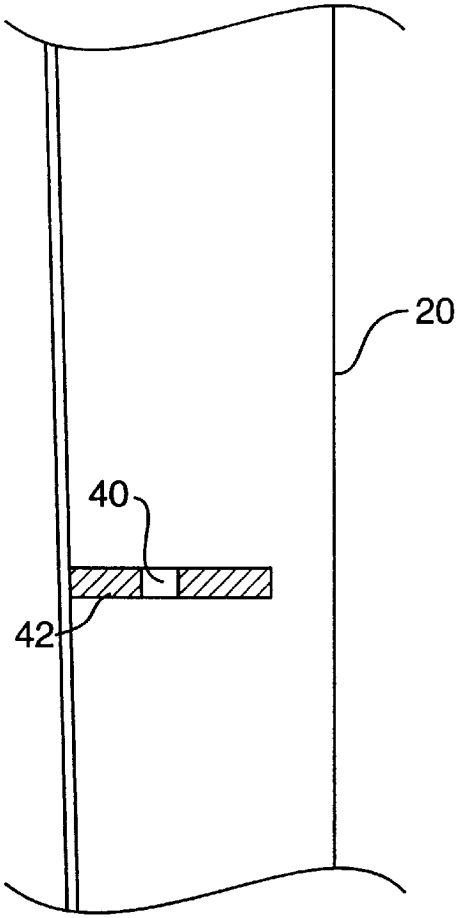
FIG. 7*b* shows an enlarged view of the leg and cleat.
Figure 7A:
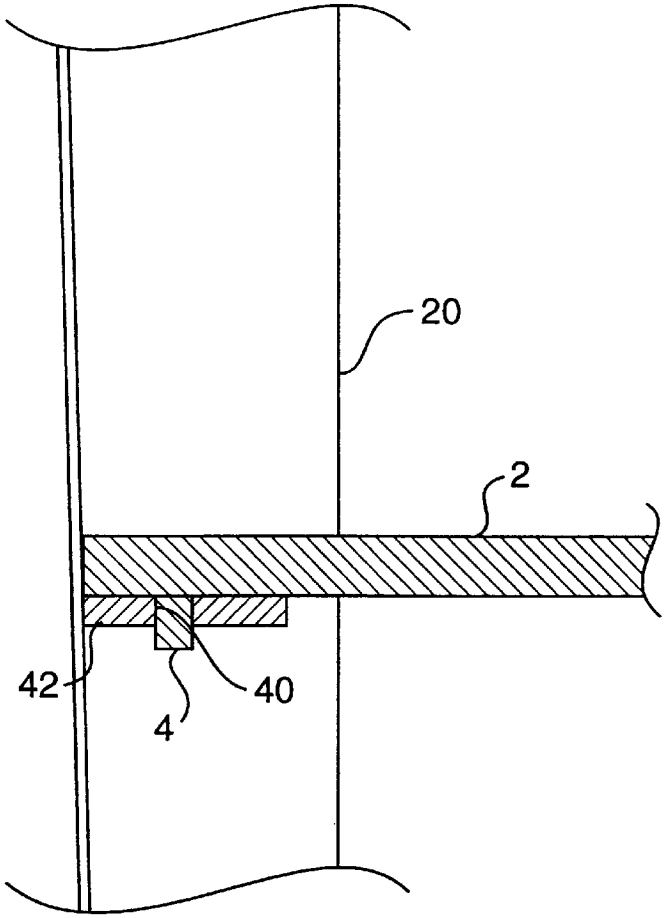
FIG. 7*a* shows an enlarged view of the leg and shelf.

FIG. 7*a* depicts an enlarged fragmentary view of the removable shelf 2 and cleat 42 union. The bottom side of the removable shelf rests on the cleat, and is securely fitted between the flanged portions of the leg 20. Extending downward from the corners of the removable shelf are downward extensions 4. The downward extensions of the removable shelf extend through the apertures 40 of the cleats 42. The union of the downward extension 4 and the aperture 40 facilitate the placement and alignment of the removable shelf with respect to the flanged legs. This union also adds to the stability and strength of the table by affording a common mechanism that fastens table components. It is envisioned that the removable shelf may be placed at any one or more locations on the table legs. It is important to note that this configuration is common for all of the flanged legs 20, 22, 24 and 26. Other placement and alignment devices are also envisioned, such as turning the corners of the removable shelf downward to engage the cleats. Also, downward extensions 4 could be bolts, with nuts employed to further secure the removable shelves to cleats. In addition, multiple removable shelves could be used in alternative embodiments of the present invention.

FIG. 7*b* shows flanged leg 20 and cleat 42. Within the cleat is an aperture 40. The apertures facilitate the placement and alignment of the removable shelf with respect to the flanged legs by permitting the downward extensions of the removable shelf to extend therethrough.

Figure 6A:
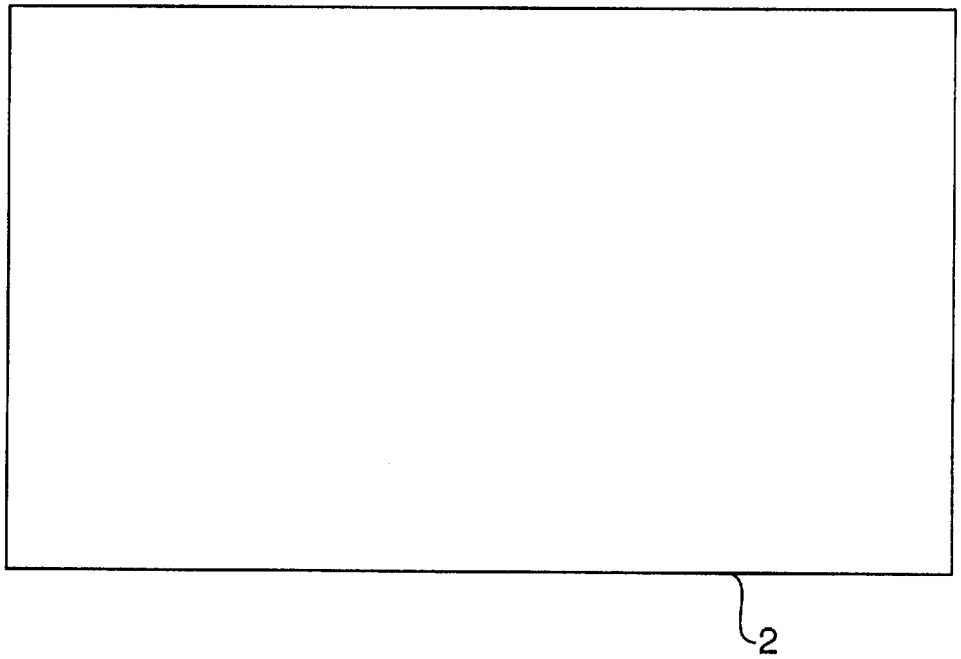
FIG. 6*a* shows a shows a plan view of the upper side of a shelf.
Figure 6B:
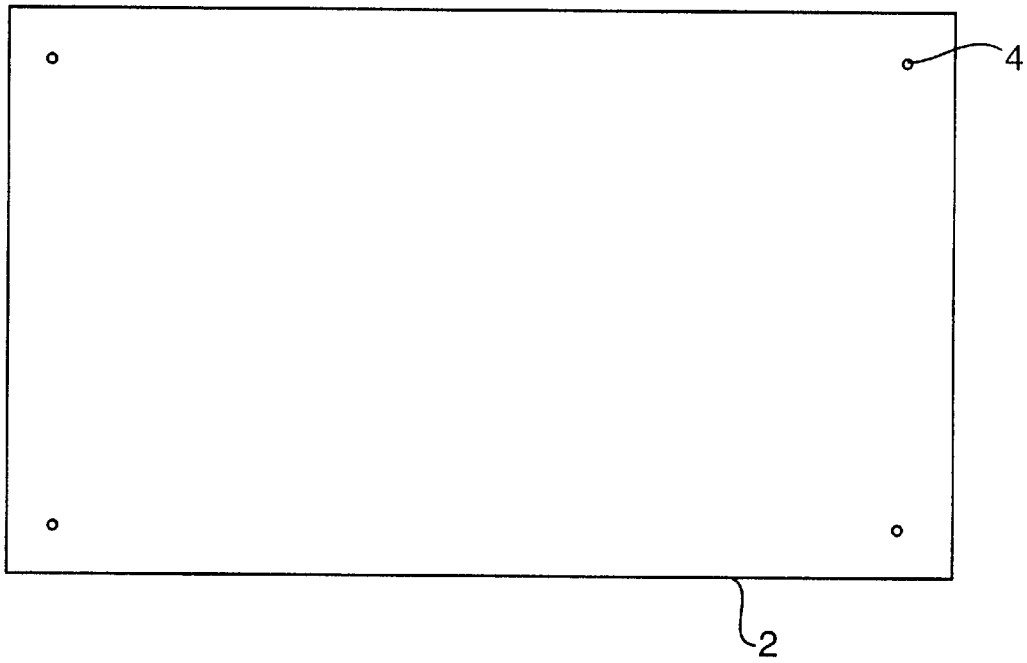
FIG. 6*b* shows a shows a plan view of the bottom side of a shelf.

Referring now to FIGS. 6*a* and 6*b*, a top and bottom view of the removable shelf are shown, respectively. In the preferred embodiment, the removable shelf is flat and rectangular or square, assuming the same shape as the decorative top 1 of the particular table. As depicted in FIG. 6*b*, downward extensions 4 are spot welded or integrally molded to the underside of the removable shelf proximate to its corners. The downward extensions align and cooperate with the apertures of the cleats. The combination of the downward extensions and apertures facilitates the placement and alignment of the shelves in relation to the other components of the KD Table. This union further adds to the stability and strength of the table by providing a mechanism that further limits potential movement of the legs relative to each other and to the table frame.

Figure 9:
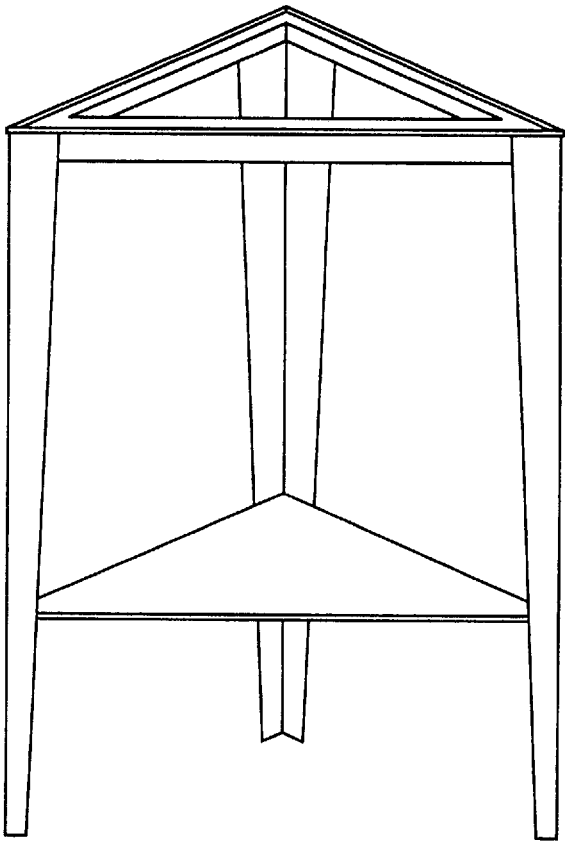
FIG. 9 shows an alternate embodiment of the Knock-Down Table

FIG. 9 shows another alternate embodiment of the KD Table. In this embodiment, the table has three sides and is used as a corner table, for example. The corner table has three legs mounted to the underside of the top frame in the same manner as explained above. The corner table can also have shelves located at any level below the table top. It is preferred that the corner table be triangular in shape. Other than being a corner table having three legs and three sides, the construction of this table is identical to that described above.

Preferred and alternate embodiments of the KD Table have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons skilled in the art. For instance, it is obvious to one skilled in the art that alternate embodiments of the KD Table can include several variations of the table, such as corner and cocktail tables, various round and oval shapes (wherein, legs would be round or oval, respectively, in cross section), and any other polygonal shape with five or more sides; in addition, in the case of flanged legs, angles between the two sides can be greater than or less than 90 degrees, according to the angles of the corners of the downward depending walls of the top frame.

I claim:

1. A knock-down table comprising:

a. a top frame comprising:

a horizontal surface with edges, a topside, and an underside;

a lip extending upward from the edges of the topside;

a plurality of corners; and a plurality of downward depending walls attached to the underside of the top frame's horizontal surface proximate the edges, the downward depending walls each comprising:

a top edge;
a bottom edge;
first and second end edges; and
a cutout located at each corner formed by an end edge and a top edge, wherein the cutouts form channels at each of the underside corners of the horizontal surface of the top frame;

b. a plurality of bolt assemblies, each bolt assembly attached to the underside of the top frame's horizontal surface proximate to a corner;

c. a plurality of flanged legs, each flanged leg comprising:
a top;
a bottom;
two sides connected to form a roughly L-shaped flange in cross section, and each side comprising an inner side and an outer side; and
a plate located at the top of each flanged leg and attached to the two inner sides of the flanged leg, for extending through a channel at a corner of the top frame, the plate comprising a hole therethrough in the form of a slot for receiving a bolt assembly from the top frame; and d. a plurality of removable table tops that fit upon the topside of the top frame's horizontal surface and within the lip thereof.

2. The knock-down table according to claim 1, wherein the plurality of downward depending walls comprises four downward depending walls, the plurality of bolt assemblies comprises four bolt assemblies, and the plurality of flanged legs comprises four flanged legs.

3. The knock-down table according to claim 2, wherein each of the four bolt assemblies extends through the slot located in the plate of the respective flanged leg.

4. The knock-down table according to claim 1, further comprising a nut placed on each bolt assembly for tightening the nut against the plate of each flanged leg.

5. The knock-down table according to claim 1, wherein the plurality of downward depending walls comprises one downward depending wall having three 90 degree bends.

6. The knock-down table according to claim 1, further comprising
a plurality of locator pins, each locator pin attached to the underside of the top frame's horizontal surface proximate to a bolt assembly; and
a guide hole in each flanged leg plate for receiving therethrough the locator pin.

7. The knock-down table according to claim 6, further comprising a nut placed on each bolt assembly for tightening the nut against the plate of each flanged leg.

8. The knock-down table according to claim 1, wherein the inner side of the top of each leg rests against two downward depending walls at a corner of the top frame.

9. The knock-down table according to claim 1, wherein the sides of the flanged legs are tapered, with the widest section being at the top of the flanged leg.

10. The knock-down table according to claim 1, further comprising at least one removable shelf for horizontal placement beneath the top frame and between the plurality of flanged legs.

11. The knock-down table according to claim 10, further comprising cleats attached to the inner sides of each of the plurality of flanged legs, each cleat comprising an aperture therethrough.

12. The knock-down table according to claim 11, further comprising a downward extension attached to the underside and proximate to each corner of the removable shelf, each downward extension engaging the cleat of the respective flanged leg.

13. The knock-down table according to claim 1, further comprising cutouts in the lip of the top frame to facilitate removal of a removable table top.

14. A method for constructing a knock-down table comprising:

a. fabricating a top frame comprising:
a horizontal surface with edges, a topside, and an underside;
a lip extending upward from the edges of the topside;
a plurality of corners, and
a plurality of downward depending walls attached to the underside of the top frame's horizontal surface proximate the edges, the downward depending walls each comprising:
a top edge,
a bottom edge;
first and second end edges; and
a cutout located at each corner formed by an end edge and a top edge, wherein the cutouts form channels at each of the underside corners of the horizontal surface of the top frame;

b. attaching a plurality of bolt assemblies to the underside of the top frame's horizontal surface, each bolt assembly situated proximate to a corner thereof;

c. fabricating a plurality of flanged legs, each flanged leg comprising:
a top;
a bottom,
two sides connected to form a roughly L-shaped flange in cross section, and each side comprising an inner side and an outer side;
at least one cleat attached to the two inner sides of each flanged leg, each cleat comprising an aperture therethrough; and
a plate located at the top of each flanged leg and attached to the two inner sides of the flanged leg, the plate comprising a hole therethrough in the form of a slot for receiving a bolt assembly from the top frame;

d. fabricating a plurality of removable table tops that fit upon the topside of the top frame's horizontal surface and within the lip thereof;

e. fabricating at least one removable shelf for horizontal placement beneath the top frame and between the plurality of legs, the removable shelf comprising a downward extension attached to the underside and proximate to each corner of the removable shelf, for engaging the to cleat aperture of the respective flanged leg;

f. assembling the knock down table by inserting, at each corner of the top frame, the plate of the respective leg into the channel, and engaging the corner bolt assembly with the plate's slot; and g. selecting a removable table top and placing the removable table top on the horizontal surface of the top frame, and within the confines of the lip.

15. A method of constructing a knock-down table according to claim 14, further comprising placing a nut on each bolt assembly and tightening each nut against the plate of the respective flanged leg.

16. A method of constructing a knock-down table according to claim 14, further comprising inserting the downward extensions of a removable shelf into the apertures in the cleats of the respective flanged legs.

17. A method of constructing a knock-down table according to claim 15, further comprising inserting the downward extensions of a removable shelf into the apertures in the cleats of the respective flanged legs.

18. A method of constructing a knock-down table according to claim 14, further comprising:

attaching a plurality of locator pins to the underside of the top frame's horizontal surface, each locator pin attached proximate to a bolt assembly;

creating a guide hole through each flanged leg's plate; and engaging each locator pin with the guide hole in the plate of the respective flanged leg.

19. A method of constructing a knock-down table according to claim 14, further comprising creating cutouts in the lip of the top frame to facilitate removal of a removable table top.

20. A knock-down table comprising:

a. a top frame comprising:

a horizontal surface with three edges, a topside, and an underside, a lip extending upward from the edges of the topside; three corners; and three downward depending walls attached to the underside of the top frame's horizontal surface proximate the edges, the downward depending walls each comprising:

a top edge;

a bottom edge;

first and second end edges; and a cutout located at each corner formed by an end edge and a top edge, wherein the cutouts form channels at each of the three underside corners of the horizontal surface of the top frame;

b. three bolt assemblies, each bolt assembly attached to the underside of the top frame's horizontal surface proximate to a corner;

c. three flanged legs, each comprising:

a top;

a bottom;

two sides connected to form a roughly L-shaped flange in cross section, and each side comprising an inner side and an outer side;

a plate located at the top of each flanged leg and attached to the two inner sides of the flanged leg, for extending through a channel at a corner of the top frame, the plate comprising a hole therethrough in the form of a slot for receiving a bolt assembly from the top frame; and at least one cleat attached to the two inner sides of each flanged leg, each cleat comprising an aperture therethrough;

d. a plurality of removable table tops that fit upon the topside of the top frame's horizontal surface and within the lip thereof, and e. at least one removable shelf, for horizontal placement beneath the top frame and between the three flanged legs, the removable shelf comprising a downward extension attached to the underside and proximate to each corner of the removable shelf, each downward extension engaging the cleat of the respective flanged leg.

21. A knock-down table according to claim 20, further comprising:

a guide hole in the plate of each flanged leg; and a plurality of locator pins, each locator pin attached to the underside of the top frame's horizontal surface proximate to a bolt assembly, for extending through the guide hole of the plate of a flanged leg.

22. A knock-down table according to claim 20, further comprising a nut placed on each bolt assembly for tightening the nut against the plate of the respective flanged leg.

23. A knock-down table according to claim 21, further comprising a nut placed on each bolt assembly for tightening the nut against the plate of the respective flanged leg.

24. A knock-down table according to claim 20, further comprising cutouts in the lip of the top frame to facilitate removal of a removable table top.

* * * * *